US007988547B2

(12) United States Patent
Moshal

(10) Patent No.: US 7,988,547 B2
(45) Date of Patent: Aug. 2, 2011

(54) JACKPOT WAGERING WITH SUPPLEMENTARY DRAW

(75) Inventor: Martin Moshal, Marina Bay (GI)

(73) Assignee: Waterleaf Limited, Douglas (IM)

( * ) Notice: Subject to any disclaimer, the term of this patent is extended or adjusted under 35 U.S.C. 154(b) by 1413 days.

(21) Appl. No.: 10/542,996

(22) PCT Filed: Jan. 19, 2004

(86) PCT No.: PCT/IB2004/000108

§ 371 (c)(1),
(2), (4) Date: Apr. 5, 2006

(87) PCT Pub. No.: WO2004/066061

PCT Pub. Date: Aug. 5, 2004

(65) Prior Publication Data

US 2006/0211465 A1 Sep. 21, 2006

(30) Foreign Application Priority Data

Jan. 21, 2003 (GB) ..... 0301341.4

(51) Int. Cl.
*A63F 9/24* (2006.01)

(52) U.S. Cl. ..... 463/17; 463/16; 463/20; 463/26; 463/27; 463/28; 463/42

(58) Field of Classification Search ..... 463/16–17, 463/20, 26–28, 42
See application file for complete search history.

(56) References Cited

U.S. PATENT DOCUMENTS 5,078,405 A * 1/1992 Jones et al. ..... 463/27
5,332,219 A * 7/1994 Marnell et al. ..... 463/13
5,344,144 A 9/1994 Canon
5,364,104 A * 11/1994 Jones et al. ..... 273/292
5,476,259 A 12/1995 Weingardt
5,564,700 A * 10/1996 Celona ..... 463/27
5,984,779 A 11/1999 Bridgeman et al.
6,019,374 A 2/2000 Breeding (Continued)

OTHER PUBLICATIONS

Supplementary European Search Report from Related Application No. EP 04 70 3224, dated Jan. 30, 2007.

(Continued)

*Primary Examiner* — Dmitry Suhol
*Assistant Examiner* — Michael Grant
(74) *Attorney, Agent, or Firm* — McDonnell Boehnen Hulbert & Berghoff LLP

(57) ABSTRACT

A jackpot wagering system includes a number of player terminals, a random event generator and an accumulation facility. Each player terminal is operable by a respective player to place a corresponding wager on one or more different turns of a game of chance, while the accumulation facility is responsive to placement of each wager to accumulate a portion thereof in an accumulation account; The random event generator is activatable by placement of each wager to generate a random event upon which an outcome of a turn of the game of chance is based, the outcome being one of a number of possible outcomes that includes a favorable outcome causing the player who placed that wager to win the contents of the accumulation account. The jackpot wagering system also includes an enrolling means capable of enrolling each player in a lottery during a predetermined time period as a function of that player's corresponding wagers on the one or more different turns of the game of chance, and a selection means activatable to randomly select one of the enrolled players as a winner of the lottery, the winner of the lottery being awarded the contents of the accumulation account.

16 Claims, 1 Drawing Sheet

U.S. PATENT DOCUMENTS

| | | | | |
|---|---|---|---|---|
| 6,217,448 | B1 | 4/2001 | Olsen | |
| 6,270,409 | B1 | 8/2001 | Shuster | |
| 6,416,409 | B1 * | 7/2002 | Jordan | 463/27 |
| 6,435,968 | B1 * | 8/2002 | Torango | 463/27 |
| 2001/0038178 | A1 * | 11/2001 | Vancura | 273/274 |
| 2003/0009375 | A1 * | 1/2003 | Stoltz et al. | 705/14 |

OTHER PUBLICATIONS

International Search Report and Written Opinion for International Application PCT/IB04/000108, issued Jun. 13, 2005.

* cited by examiner

JACKPOT WAGERING WITH SUPPLEMENTARY DRAW

FIELD OF THE INVENTION

This invention relates to a system for jackpot wagering and, more particularly, but not exclusively, to a system for jackpot wagering in relation to casino games. The invention extends to a method for jackpot wagering in relation to casino games.

BACKGROUND TO THE INVENTION

Jackpot wagering systems are well known in land-based and online casinos. The most common such wagering system is found in a simple three-reel slot machine game. Each reel of the slot machine has, say, 30 indexed positions, some of which may display a corresponding indicium. A player of the slot machine is required to place a wager by introducing coins, tokens or credit into the slot machine, which then enables the reels to be spun and to come to rest at any of the indexed positions. One combination of indexed rest positions usually allows the player to win a prize consisting of a fixed jackpot. A slot machine with this particular geometry provides the player with a 1 in 27 000 chance of winning the fixed jackpot.

In order to take advantage of the random nature of the indexed rest positions of the reels, it is known to replace the fixed jackpot by a progressive jackpot in which a proportion of each wager placed by the player of the slot machine is used to increment the jackpot progressively. The randomness makes it possible for the progressive jackpot to become large relative to the fixed jackpot described above, which enhances the attractiveness of the slot machine to would-be players thereof. It must, of course, be appreciated that the randomness also raises the possibility of the progressive jackpot being won when it is small relative to the above fixed jackpot.

The probability of winning the jackpot is the reciprocal of the number of all possible outcomes of the game, which will be referred to as the jackpot cycle of the game, for convenience. As an illustration, the jackpot cycle of the three-reel slot machine earlier in this specification is 27 000. This means that, on average, 27 000 outcomes of the game must be determined in order for the contents of the progressive jackpot, or accumulation account, to be won by the player.

The next step in the evolution of jackpot wagering systems was to link multiple slot machines having identical jackpot cycles to the same progressive jackpot, leading to the creation of larger and more attractive jackpots. Initially, the multiple identical slot machines linked to such progressive jackpots were in close proximity, such as within a land-based casino, but the advent of low-cost telecommunication soon enabled multiple clusters of identical slot machines to be linked to a single progressive jackpot. It is a characteristic of such distributed progressive jackpot wagering systems that they are restricted to casinos belonging to a single business enterprise.

The advent of the Internet has led to a proliferation of online casinos, bringing online gaming within the reach of anyone with access to the World Wide Web of the Internet. Jackpot wagering systems and progressive jackpot wagering systems have now become available through such online casinos. Online progressive jackpot wagering systems have evolved further to a point where it is now known for players at competing online casinos to be able to play identical casino games linked to a common progressive jackpot. Access to these types of progressive jackpot wagering systems is provided through jackpot portals on the World Wide Web.

An advantage of online jackpot wagering systems is that they can be operated in conjunction with casino games having very large jackpot cycles, which allows for progressive jackpots of substantial sizes to accumulate. Although large progressive jackpots are desirable to players, it is necessarily so that large progressive jackpots are won less frequently than smaller ones, and this fact can act as a disincentive to would-be players of the game, who may become disillusioned or bored and leave the casino games.

OBJECT OF THE INVENTION

It is an object of this invention to provide a jackpot wagering system, and a method for jackpot wagering that will, at least partially, alleviate the abovementioned difficulties and disadvantages,

SUMMARY OF THE INVENTION

In accordance with this invention there is provided a jackpot wagering system, comprising:

a plurality of player terminals, each player terminal being operable by a respective player to place a corresponding wager on each one of a plurality of different turns of a game of chance;

an accumulation facility responsive to placement of each wager to accumulate a portion thereof in an accumulation account; and a random event generator activatable by placement of each wager to generate a random event upon which an outcome of a turn of the game of chance is based, the outcome being one of a number of possible outcomes that includes a favourable outcome causing the player who placed that wager to win the contents of the accumulation account characterised in that the system includes:

enrolling means operable to enrol, during a determinable time interval, each player in a lottery as a function of that player's corresponding wagers on each one of the plurality of different turns of the game of chance and to cancel the lottery upon the occurrence of a favourable outcome of the game of chance during the determinable time interval; and selection means activatable to select, if a favourable outcome of the game of chance does not occur during the determinable time interval, one of the enrolled players as a winner of the lottery as a function of a contingency determined at least by chance, the winner of the lottery being awarded the contents of the accumulation account.

Further features of the invention provide for the enrolling means to be operable to enrol each player in the lottery once for every 10 different turns of the game of chance on which the player has placed a wager, alternatively once for every 15 different turns of the game of chance on which the player has placed a wager.

Still further features of the invention provide for the selection means to select the winner of the lottery at the expiry of the determinable time interval, and for the determinable time period to have a predetermined start time and to expire a finite time after the predetermined start time or when the balance of the accumulation account exceeds a predetermined threshold.

Yet further features of the invention provide for each enrolment of a player in the lottery to be uniquely identifiable by means of a corresponding unique code, and for the selection means to be a random number generator arranged to generate a random number corresponding one of the unique codes.

The invention extends to a method for jackpot wagering, comprising the steps of:

placing a corresponding wager on each one of a plurality of turns of a game of chance from any one of a plurality of player terminals, each terminal being operated by a respective player;

accumulating a portion of each wager in an accumulation account; and generating, in response to placement of each wager, a random event upon which an outcome of a turn of the game of chance is based, the outcome being one of a number of possible outcomes that includes a favourable outcome causing the player who placed that wager to win the contents of the accumulation account characterised in that the method includes the additional steps of:

enrolling, during a determinable time interval, each player in a lottery as a function of that players corresponding wagers on each one of the plurality of different turns of the game of chance;

cancelling the lottery if a favourable outcome of the game of chance occurs during the determinable time interval;

selecting, if a favourable outcome of the game of chance does not occur during the determinable time interval, one of the enrolled players as a winner of the lottery as a function of a contingency determined at least by chance; and awarding the contents of the accumulation account to the winner of the lottery.

There is further provided for enrolling each player in the lottery once for every 10 different turns of the game of chance on which the player has placed a wager, alternatively once for every 15 different turns of the game of chance on which the player has placed a wager.

There is still further provided for selecting the winner of the lottery at the expiry of the determinable time interval, and for the determinable time period to have a predetermined start time and to expire a finite time after the predetermined start time or when the balance of the accumulation account exceeds a predetermined threshold.

There is yet further provided for the method to include the further step of uniquely identifying each enrolment of any player in the lottery by means of a unique code, and for selecting the winner of the lottery by generating a random number corresponding to one of the unique codes.

BRIEF DESCRIPTION OF THE DRAWINGS

A preferred embodiment of the invention is described below, by way of example only, and with reference to the abovementioned drawings, in which.

DETAILED DESCRIPTION OF THE INVENTION

Figure 1:
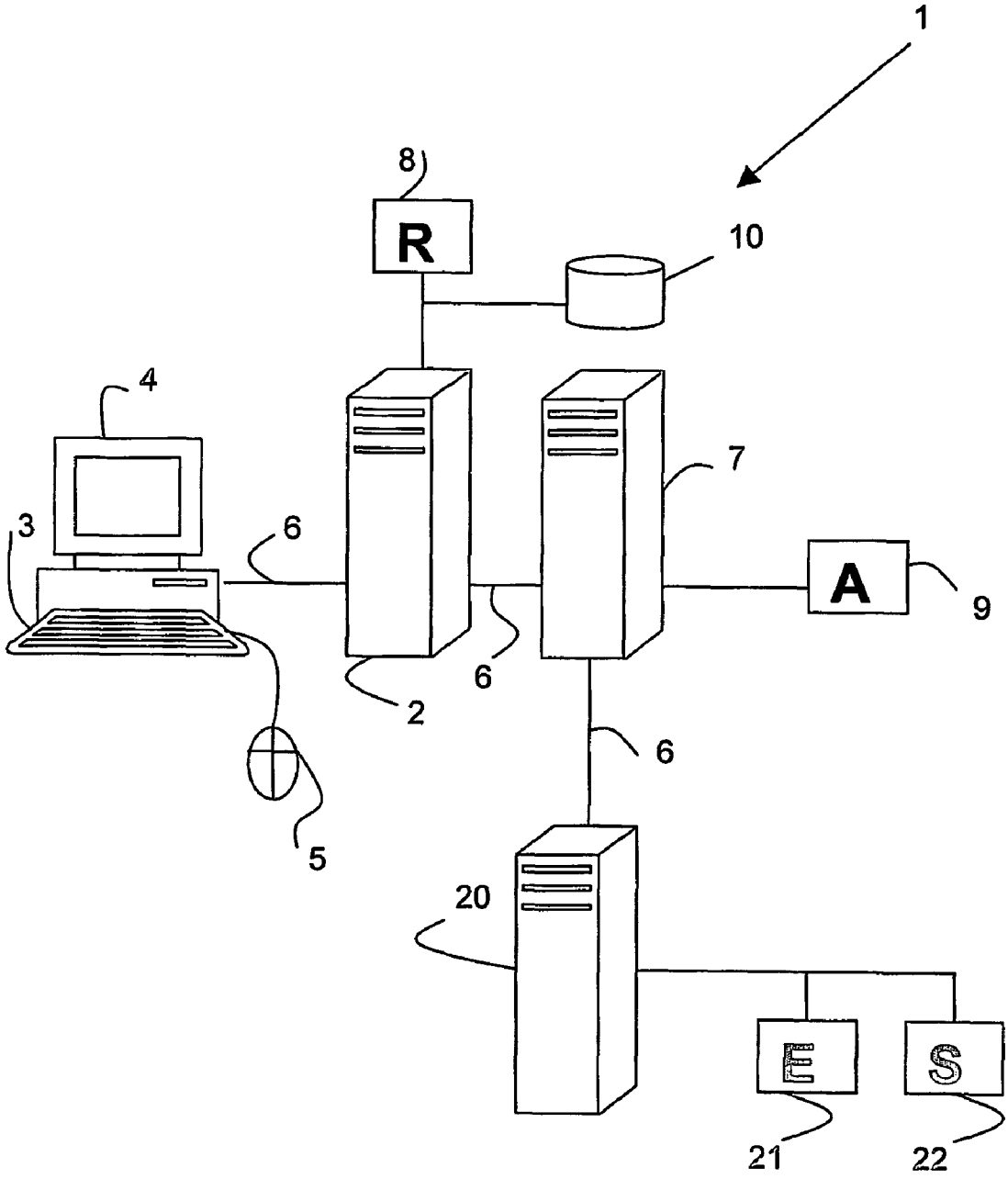
FIG. 1 is a schematic representation of a jackpot wagering system according to the invention.

Referring to FIG. 1, a jackpot wagering system is indicated generally by reference numeral (1)

The jackpot wagering system includes a gaming server (2) and one or more player terminals, each in the form of a computer workstation (3) with an associated display monitor (4) and a pointing device (5), such as a mouse or a touch pad. The computer workstation (3) is located remotely from the gaming server (2) and communication between the computer workstation and the gaming server is provided across a communication network (6) that is, in this embodiment, the Internet. The system (1) also includes an accumulation facility (7) in the form of an application server, and a lottery server (20), both of which are connected to the communication network (6).

The computer workstation (3) is a conventional personal computer operating under a Windows 2000 operating system, which is well known and commercially available from the Microsoft Corporation of Seattle, Wash., USA. The computer workstation (3) executes a software simulation program that simulates the progress of a game of chance. The generic operation of the simulation program will be described in more detail in the description that follows.

The gaming server (2) includes a random event generator in the form of a computer program (8) that is executable to generate random events upon which an outcome of the games of chance is based. The gaming, application and lottery servers (2,7 and 20) operate under the Windows NT operating system, which is also well known and commercially available from the Microsoft Corporation. The application server (7) executes an accumulation software program (9) that communicates with the gaming server (2), while the lottery server (20), which is also in communication with the gaming server, executes software programs (21,22) that provide the functionality of an enrolling facility and a selection facility, respectively.

A player wishing to use the jackpot wagering system (1) is first required to register and to create an account on the gaming server (2). The player is then required to pre-fund the account by purchasing credit that will, for convenience, be denominated in this description in "units". The gaming server (2) stores a credit balance corresponding to the player's account at all times.

In order to commence, the player uses the computer workstation (3) to log onto the gaming server (2) and initiates execution of the simulation software program, which displays an appropriate image of a game of chance on the display monitor (4). The player now enters a betting phase of the game of chance by making a wager on the game. The player may make any wager that is permitted for the particular game of chance. The player's wager is denominated as an integral number of units of credit. The simulation program displays the size of the player's wager on the display monitor (4). There must be sufficient credit in the player's account to cover any wager that is made by the player. The computer workstation (3) transmits data relating to the type and size of the wager made by the player, across the communication network (6) to the gaming server (2) where it is recorded in a database on an associated storage device (10), such as a magnetic or an optical storage disk.

The gaming server (2) forwards data relating to the size of each wager across the communication network (6) to the application server (7) where it is processed by the accumulation software program (9). The accumulation software program (9) maintains a balance of an accumulation account on the application server (7) and increments this balance by an amount equal to a predetermined portion of each wager made by the player. In this embodiment, the predetermined portion of each wager that is accumulated in this manner is 3 percent.

It is envisaged that a plurality of different players may each simultaneously use the jackpot wagering system (1), each from a different computer workstation (3) corresponding to a respective player terminal. The accumulation software program (9) increments the balance of the accumulation account by an amount corresponding to a predetermined portion of each wager made by each one of the plurality of different players using the jackpot wagering system (1). It will be appreciated by those skilled in the art that the balance of the accumulation account can rapidly become large, which renders the jackpot wagering system (1) attractive to participating and would-be players.

The game of chance has a favourable outcome, three intermediate outcomes, and a plurality of unfavourable outcomes. When the random event generator (8) generates random events that result in an unfavourable outcome, the player's wager is forfeited to an operator of the jackpot wagering system (1). When a favourable outcome of the game of chance occurs, the player wins the entire contents of the accumulation account. When an intermediate outcome occurs, the player wins the wager at corresponding fixed odds.

The operator of the of the jackpot wagering system (1) may determine a time interval during which to run an associated supplementary game, as follows:

1. during the time interval, the enrolling facility (21) monitors the play of each participating player and enrols the players in a lottery, or supplementary draw. Each player is enrolled in the lottery once for every 15 wagers that the player places on the game of chance, thereby rewarding a player with multiple enrolments in the lottery in proportion to his continued participation in the game of chance;
2. each enrolment of any player in the lottery is uniquely identified by means of a corresponding unique code;
3. upon expiry of the time interval, the selection facility (22) selects a winner of the lottery by generating a random number that maps to one of the unique codes associated with the various player enrolments in the lottery.
4. the winner of the lottery is awarded the contents of the accumulation account, and the balance of the accumulation account is re-set to zero or to any other desired starting value.
5. if a favourable outcome for the game of chance occurs during the time interval, the lottery is cancelled, all enrolments in the lottery become void and the player with the favourable outcome wins the contents of the accumulation account as described above.

The time interval has a predetermined start time and is of a fixed duration. It is anticipated that the operator of the jackpot wagering system will establish the predetermined time window for the lottery when the balance of the accumulation account has become sufficiently large. It will be appreciated that the odds of winning the supplementary draw are more favourable to a player than the odds of a favourable outcome occurring during normal progress of the game of chance itself. It is thus further anticipated that the lottery, or supplementary draw, will encourage players to play the game of chance during the lottery time interval in order to qualify for enrolment in the lottery. There is likely to be an increasing level of activity by participating players in the game of chance as the time interval draws to a close.

It will be further appreciated by those skilled in the art that a jackpot wagering system according to the invention exhibits a greater degree of functionality than prior art systems. The technical problem solved by this invention is that of providing a supplementary draw associated with a jackpot wagering system in which a scale of a player's participation in the supplementary draw is directly proportional to that player's participation in an underlying game of chance that forms a basis for the jackpot wagering system. The use of an open communication channel such as the Internet to provide communication between various components of the jackpot wagering system (1) removes any geographical or organisational limitations that are characteristic of prior art jackpot wagering systems.

Numerous modifications are possible to this invention without departing from the scope of the invention. In particular, the duration of the window during which lottery enrolment can occur may terminate when the balance of the accumulation account has reached a predetermined threshold, instead of terminating upon the expiry of a predetermined time interval. Further, the lottery server (20) may be combined with the application server (7) in order to reduce the complexity of the system (1). Still further, the portion of a player's wager that is accumulated in the accumulation account may be variable portion of the wager instead of being a fixed portion thereof. For example, larger contributions, say 5 percent of the wager, may be accumulated in the accumulation account when the balance of the account is small, decreasing linearly to a minimum of 3 percent as the balance of the accumulation account increases. Yet further, the underlying game of chance may have five partially favourable outcomes instead of three.

The invention therefore provides a jackpot wagering system (1) that provides players with automatic participation in a supplementary draw associated with a game of chance.

The invention claimed is:

1. A method of operating a jackpot wagering system, comprising the steps of:

providing via a gaming server a game of chance for a plurality of players, wherein a player places a wager on a turn of the game of chance and obtains an outcome based on a random event generated by the gaming server, the outcome being one of at least a favorable outcome in which the player wins the contents of an accumulation account, an intermediate outcome in which the player wins the wager at fixed odds, and an unfavorable outcome in which the player forfeits the wager;

accumulating, via an accumulation facility, a portion of each wager in the accumulation account, wherein the accumulation facility is in communication with the gaming server via a communication network;

defining, via a lottery server, a time interval for a lottery associated with the game of chance, wherein the lottery server is in communication with the gaming server via the communication network;

during the defined time interval, rewarding, via the lottery server, each player participating in the game of chance who qualifies for enrollment with at least one enrollment in the lottery;

determining, via the lottery server, whether the favorable outcome of the game of chance occurs during the defined time interval, wherein the lottery server is programmed to (i) if the favorable outcome of the game of chance occurs during the defined time interval, cancel the lottery and void all enrollments in the lottery and (ii) if the favorable outcome of the game of chance does not occur during the defined time interval, randomly select one of the enrollments in the lottery and award the contents of the accumulation account to the player with the selected enrollment as winner of the lottery.

2. The method of claim 1, wherein rewarding, via the lottery server, each player participating in the game of chance who qualifies for enrollment with at least one enrollment in the lottery comprises: rewarding, via the lottery server, a player participating in the game of chance with multiple enrollments in the lottery in proportion to the player's participation in the game of chance.

3. The method of claim 1, wherein rewarding, via the lottery server, each player participating in the game of chance who qualifies for enrollment with at least one enrollment in the lottery comprises: rewarding, via the lottery server, a player participating in the game of chance with one enrollment for every 10 turns of the game of chance on which the player has placed a wager.

4. The method of claim 1, wherein rewarding, via the lottery server, each player participating in the game of chance who qualifies for enrollment with at least one enrollment in the lottery comprises: rewarding, via the lottery server, a player participating in the game of chance with one enrollment for every 15 turns of the game of chance on which the player has placed a wager.

5. The method of claim 1, wherein the defined time interval has a fixed duration.

6. The method of claim 1, wherein the defined time interval expires when the balance of the accumulation account exceeds a predetermined threshold.

7. The method of claim 1, wherein each enrollment in the lottery is uniquely identified by a unique code.

8. The method of claim 7, wherein the lottery server is programmed to randomly select one of the enrollments in the lottery by a process comprising:

generating a random number that maps to one of the unique codes associated with the enrollments in the lottery.

9. A jackpot wagering system, comprising:

a gaming server that communicates with a plurality of player terminals across a communication network, wherein the gaming server is configured to generate random events upon which outcomes of a game of the chance are based, wherein each player terminal is operable by a respective player to place a wager on a turn of the game of chance and obtain an outcome based on a random event generated by the gaming server, the outcome being one of at least a favorable outcome in which the respective player wins the contents of an accumulation account, an intermediate outcome in which the respective player wins the wager at fixed odds, and an unfavorable outcome in which the respective player forfeits the wager;

an accumulation facility in communication with the gaming server via the communication network, wherein the accumulation facility is configured to accumulate a portion of each wager in the accumulation account;

a lottery server in communication with the gaming server via the communication network, wherein the lottery server is programmed to: (i) run a lottery that is associated with the game of chance during a defined time interval; (ii) during the defined time interval, reward each player participating in the game of chance who qualifies for enrollment with at least one enrollment in the lottery; (iii) determine whether the favorable outcome of the game of chance occurs during the defined time interval; (iv) if the favorable outcome of the game of chance occurs during the defined time interval, cancel the lottery and void all enrollments in the lottery; and (v) if the favorable outcome of the game of chance does not occur during the defined time interval, select a winner of the lottery by randomly selecting one of the enrollments in the lottery, wherein the winner of the lottery is awarded the contents of the accumulation account.

10. The system of claim 9, wherein the lottery server is able to reward a player participating in the game of chance with multiple enrollments in the lottery in proportion to the player's participation in the game of chance.

11. The system of claim 9, wherein the lottery server is programmed to reward a player participating in the game of chance with one enrollment for every 10 turns of the game of chance on which the player has placed a wager.

12. The system of claim 9, wherein the lottery server is programmed to reward a player participating in the game of chance with one enrollment for every 15 turns of the game of chance on which the player has placed a wager.

13. The system of claim 9, wherein the defined time interval has a fixed duration.

14. The system of claim 9, wherein the defined time interval expires when the balance of the accumulation account exceeds a predetermined threshold.

15. The system of claim 9, wherein each enrollment in the lottery is uniquely identified by a unique code.

16. The system of claim 15, wherein the lottery server is programmed to randomly select one of the enrollments in the lottery by generating a random number that maps to one of the unique codes associated with the enrollments in the lottery.

* * * * *